United States Patent [19]

Yagi et al.

[11] 4,444,862

[45] Apr. 24, 1984

[54] ELECTROPHOTOGRAPHIC PHOTOSENSITIVE MATERIALS HAVING LAYER OF ORGANIC METAL COMPOUND

[75] Inventors: Shigeru Yagi; Koichi Yamamoto; Yasutoshi Okugawa, all of Kanagawa, Japan

[73] Assignee: Fuji Xerox Co., Ltd., Tokyo, Japan

[21] Appl. No.: 402,700

[22] Filed: Jul. 28, 1982

[30] Foreign Application Priority Data

| | | | |
|---|---|---|---|
| Jul. 28, 1981 | [JP] | Japan | 56-117108 |
| Jul. 28, 1981 | [JP] | Japan | 56-117110 |
| Oct. 8, 1981 | [JP] | Japan | 56-159420 |

[51] Int. Cl.[3] ..... G03G 5/14

[52] U.S. Cl. ..... 430/67; 430/524

[58] Field of Search ..... 430/66, 67, 65, 524, 430/64; 260/45.75

[56] References Cited

U.S. PATENT DOCUMENTS 3,966,471 6/1976 Hasegawa et al. ..... 430/67

FOREIGN PATENT DOCUMENTS 50-98331 8/1975 Japan .

50-110639 8/1975 Japan .

*Primary Examiner*—John D. Welsh

*Attorney, Agent, or Firm*—Sughrue, Mion, Zinn, Macpeak & Seas

[57] ABSTRACT

An electrophotographic photosensitive material is disclosed. The material is comprised of a conductive support base. On the surface of the base is a photoconductive layer. On a surface of the photoconductive layer is an interlayer comprised of organic metal compound as its main component. On top of the interlayer is a low-resistant protective layer. The material can achieve electrostatic contrast greatly superior to that of conventional photosensitive materials.

27 Claims, 1 Drawing Figure

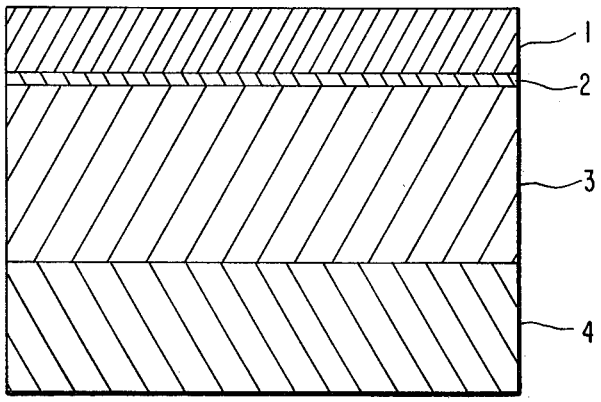
1
2
3
4

ELECTROPHOTOGRAPHIC PHOTOSENSITIVE MATERIALS HAVING LAYER OF ORGANIC METAL COMPOUND

FIELD OF THE INVENTION

This invention relates to electrophotographic photosensitive materials, and more particularly to improvements of electrophotosensitive materials having a protective layer formed on the surface of the photoconductive layer.

BACKGROUND OF THE INVENTION

Various photosensitive materials have been practically used in electrophotographic systems including the steps of charging, light exposure and development (see, e.g., U.S. Pat. No. 2,297,619). For example, it is possible to directly form, on a proper conductive base plate, an organic photoconductive material by coating or vapor deposition. In another system the aforesaid material is provided on the base plate together with a proper organic binder. It is also possible to have a binder layer formed on the base plate having dispersed therein an inorganic photoconductive material such as ZnO, CdO or $TiO_2$. In yet another system a layer of amorphous selenium or an alloy thereof is formed on the base plate by vapor deposition. It is also possible to have two or more of the above-described photoconductive layers laminated on a base plate (see, e.g., U.S. Pat. Nos. 3,850,630 and 4,175,960). For obtaining good electric and optical properties as well as mechanical properties or further improving and stabilizing or, as the case may be, improving the characteristics for processes such as development in these photosensitive materials, it has been proposed to provide a surface layer on the surface of the photosensitive material. One of these surface layers is a so-called protective layer. For example, a thin resin layer is formed on the surface of a photoconductive layer and latent images are formed by performing charging and image exposure (Carlson process). However, the use of photosensitive material having such a protective layer frequently results in the occurrence of high residual potential and large cycle increase of residual potential, providing copies having deteriorated image quality with fogging. The occurrence of high residual potential and large cycle increase of residual potential can be considerably improved by reducing the thickness of the protective layer below $1\mu$, but in this case, the layer is liable to be separated. Therefore, such a photosensitive material cannot be used for a long period of time. Another example of the surface layer is a so-called insulating layer, i.e., a resin layer having a high electric resistance, wherein latent images are formed by a specific process including an electricity eliminating process (e.g., see U.S. Pat. No. 3,041,167). However, photosensitive material having an insulating layer requires a specific latent image-forming process. For example, such a material requires at least two charging steps. Therefore, complicated apparatus is needed.

This invention relates to a photosensitive material having a former type protective layer which can form latent images by a so-called Carlson process without requiring any specific latent image-forming process.

Previously, the assignee proposed the use of a low-resistant protective layer for overcoming the above-mentioned difficulties (see, Japanese Patent Application Nos. 42,118/'79; 65,671/'79; 65,672/'79 and 65,673/'79).

By forming such a low-resistant protective layer, the thickness of the protective layer can be increased to 10–20$\mu$ and the occurrence of high residual potential and large cycle increase can be prevented. However, it has been found that in these processes, the charging characteristics of the entire photosensitive material may be reduced. Therefore, it is not possible to obtain images having sufficient contrast. This tendency is particularly remarkable with photosensitive materials having a high-sensitive photoconductive layer.

SUMMARY OF THE INVENTION

An object of this invention is to provide an electrophotographic photosensitive material capable of eliminating disadvantages as described above.

The objects of this invention can be attained by an electrophotographic photosensitive material comprising a conductive support having formed thereon, in succession, a photoconductive layer, an interlayer containing an organic metal compound as the main component, and a low-resistance protective layer.

BRIEF DESCRIPTION OF THE DRAWING

The FIGURE is a cross-sectional view of the electrophotographic photosensitive material of this invention.

DETAILED DESCRIPTION OF THE INVENTION

The constituency of the electrophotographic photosensitive material of this invention is illustrated in the accompanying drawing. In the drawing, 1 is a low-resistant transparent protective layer composed of an organic polymer having added thereto a proper organic or inorganic compound, 2 is an interlayer containing an organic metal compound, 3 is a photoconductive layer, and 4 is a conductive support.

The interlayer 2 should be constituted so as not to be affected (e.g., dissolved or permeated) by the solvent used for coating the upper protective layer. The interlayer can function as a barrier layer as well as an adhesive layer for a photoconductive layer and a protective layer.

Examples of organic metal compounds suitable for the interlayer 2 include metal acetylacetonate compounds such as aluminum tris(acetylacetonate), iron tris(acetylacetonate), cobalt bis(acetylacetonate), copper bis(acetylacetonate), magnesium bis(acetylacetonate), manganse (II) bis(acetylacetonate), nickel(II) bis(acetylacetonate), vanadium tris(acetylacetonate), zinc bis(acetylacetonate), tin bis(acetylacetonate), etc.; metal alcoholate compounds such as aluminum isopropylate, mono-sec-butoxy aluminum diisopropylate, aluminum sec-butyrate, ethylacetoacetate aluminum diisopropylate, vanadium ethylate, vanadium n-propylate, vanadium isobutyrate, etc.; and such compounds as aluminum di-n-butoxide mono-ethylacetoacetate, aluminum oxide octate, aluminum oxide stearate and aluminum oxide acrylate. Of these compounds, aluminum tris(acetylacetonate), cobalt bis(acetylacetonate) and zinc bis(acetylacetonate) are particularly preferred.

A number of organotitanium compounds have also been found to be suitable organic metal compounds for the interlayer 2. Examples of such compounds include organic derivatives of orthotitanic acid such as titanium orthoesters, etc.; polyorthotitanic acid esters; and titanium chelates.

A titanium orthoester is a compound shown by following general formula (I)

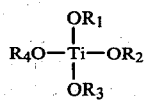

(I)

wherein $OR_1$, $OR_2$, $OR_3$, and $OR_4$ each represents an alkoxy group, a carboalkoxy group, a phenoxy group, a sulfoxy group and a phosphoxy group. Examples of titanium orthoesters include tetramethyl orthotitanate, tetraethyl orthotitanate, tetra-n-propyl orthotitanate, tetraisopropyl orthotitanate, tetrabutyl orthotitanate, tetraisobutyl orthotitanate, tetracresyl titanate, tetrastearyl titanate, tetra-2-ethylhexyl titanate, tetranonyl titanate, tetracetyl titanate, isopropyl triisostearoyl titanate, isopropyl tridodecylbenzenesulfonyl titanate, and isopropyl tris(dioctylpyrophosphate) titanate. Of these, tetramethyl orthotitanate, tetraethyl orthotitanate, tetra-n-propyl orthotitanate, tetraisopropyl orthotitanate, tetrabutyl orthotitanate, tetraisobutyl orthotitanate and tetracresyl titanate are particularly preferred.

A polyorthotitanic acid ester is a compound shown by following general formula (II)

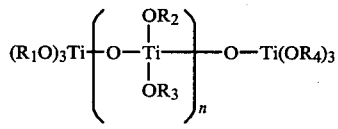

(II)

wherein $OR_1$, $OR_2$, $OR_3$, and $OR_4$ have the same significance as in aforesaid formula (I). Examples of polyorthotitanic acid esters include tetrabutyl polytitanate, tetracresyl polytitanate and tetraacetylacetonato polytitanate, with tetrabutyl polytitanate being particularly preferred.

Also, a titanium chelate is an oxygen coordination compound shown by following general formula (III)

$$Ti(L)_nX_{4-n} \quad \text{(III)}$$

wherein L represents a chelate group, X represents an ester group, and n is an integer of 1 to 4. As the ligand, there are glycols such as octylene glycol, hexanediol, etc.; β-diketones such as acetylacetone, etc.; hydroxycarboxylic acids such as lactic acid, malic acid, tartaric acid, salicylic acid, etc.; keto-esters such as acetoacetic acid ester, etc.; and keto-alcohols such as diacetone alcohol, etc. Examples of titanium chelates include diisopropoxy titanium bis(octanediol), diisopropoxy titanium bis(hexanediol), diisopropoxy titanium bis(acetylacetonate), titanium tetralactate, titanium tetralactate ethyl ester and tetratriethanolamine titanium chelate, with diisopropoxy titanium bis(acetylacetonate) being particularly preferred.

Organotitanium compounds other than those represented by the formulae (I), (II) and (III) can also be used for the purpose of this invention, such as titanium tetraammonium lactate, titanium tetraacetylacetonato ammonium lactate, tetraisopropyl bis(dioctylphosphyte) titanate, tetraoctyl bis(ditridecylphosphyte) titanate, tetra(2,2-diallyloxymethyl-1-butyl) bis(ditridecylphosphyte) titanate, bis(dioctylpilophosphate) oxyacetate titanate, tris(dioctylpylophosphate) ethylene titanate, diisopropyl ditriethanolamino titanate and bis(acetylacetonate) titanium oxide.

It is also possible to use a number of organozirconium compounds such as zirconium complexes and zirconium esters for the interlayer 2. Examples of the zirconium complexes include zirconium chelete compounds such as zirconium tetrakis(acetylacetonate), zirconium dibutoxy bis(acetylacetonate), zirconium tributoxy acetylacetonate, zirconium tetrakis(ethylacetoacetate), zirconium butoxy tris(ethylacetoacetate), zirconium dibutoxy bis(ethylacetoacetate), zirconium tributoxy monoethylacetoacetate, zirconium tetrakis(ethyllactate), zirconium dibutoxy bis(ethyllactate), bis(acetylacetonate) bis(ethylacetoacetate) zirconium, monoacetylacetonate tris(ethylacetoacetate) zirconium, and bis(acetylacetonate) bis(ethyllacetate) zirconium; and other complexes such as zirconium trifuoroacetylacetone. Examples of the zirconium esters include zirconium n-butyrate and zirconium n-propylate, Of these organozirconium compounds, zirconium tetrakis(acetylacetonate), zirconium dibutoxy bis(acetylacetonate), zirconium tributoxy acetylacetonate and zirconium n-butyrate are particularly preferred.

These organic metal compounds may be used alone or in any combination. Furthermore, in order to improve their adhesive property, control their resistance, and for other purposes, the aforesaid compounds may be used as a mixture with other organic resin compounds.

The interlayer prevents the injection of electric charges on the surface of protective layer into the photoconductive layer. If the interlayer is too electrically insulative, however, the charges are accumulated at the interface between the protective layer and the interlayer, increasing the residual potential. The increased residual potential results in fogging. Therefore, the interlayer must be electrically insulative to an extent that the charges are not accumulated at the interface to cause fogging but the charges are trapped at the interface and, upon light-exposure, allowed to recombine with charges generated in the photoconductive layer. In this respect, the interlayer has generally an electric resistance of from $10^8$ to $10^{14}$ Ωcm, preferably from $10^{10}$ to $10^{13}$ Ωcm. For the purpose, a resistance-controlling agent may be added in the interlayer, if desired. The resistance-controlling agent must not prevent the light transmission and deteriorate the adhesion between the protective layer and the photoconductive layer.

Examples of resistance-controlling agents include silicate compounds such as tetramethyl orthosilicate, tetraethyl orthosilicate, tetra-n-propyl silicate, tetramethylglycol silicate, tetraethylglycol silicate, silicon aluminium ester, methyl polysilicate and ethyl polysilicate; and silane coupling agents such as vinyl trichlorosilane, vinyl trimethoxysilane, vinyl triethoxysilane, vinyl tris(β-methoxyethoxy)silane, γ-aminopropyl triethoxysilane, γ-aminopropyl trimethoxysilane, imidazoline silane, N-aminoethylaminopropyl trimethoxysilane, triaminosilane, γ-chloropropyl trimethoxysilane, γ-chloropropyl triethoxysilane, γ-methacryloxypropyl trimethoxysilane, γ-glycidyloxypropyl trimethoxysilane, γ-mercaptopropyl trimethoxysilane and β-mercaptoethyl triethoxysilane. Of these compounds, tetramethyl orthosilicate, tetraethyl orthosilicate, ethyl polysilicate, vinyl tris(β-methoxyethoxy)silane and γ-glycidyloxypropyl trimethoxysilane are particularly preferred. The resistance-controlling agent is added in an amount of 1 to 45% by weight, preferably 10 to 35% by weight, based on the total weight of the interlayer.

There is no particular restriction with respect to the thickness of the interlayer 2. However, the thickness is preferably less than 10 μm and more preferable less than 1 μm.

The interlayer can be formed by any suitable coating method such as spray coating, dip coating, knife coating or roll coating. A coating solution of the interlayer is preferably cured at normal temperature or near the temperature after coating on the photoconductive layer since the photoconductive layer might be crystallized or deteriorated with respect to sensitivity due to heat when the coating is cured at a high temperature. Therefore, it is preferred to add a catalyst for accelerating the curing reaction in the coating solution to cure the coating at normal temperature. Examples of such catalysts include naphthenates of aluminum, zinc, lead, cobalt, manganese or zirconium, and octenates of cobalt or manganese. The catalyst is added in an amount of 1 to 10% by weight based on the weight of solid component in the coating solution.

The photoconductive layer for the photosensitive material of this invention may be a vacuum deposited layer of Se, Se-Te alloy, or Se-As alloy; vacuum deposited multilayers of a proper combination of the above materials; or a layer of an organic photoconductor such as polyvinylcarbazole/2,4,7-trinitro-9-fluorenone (PVK/TNF), etc., or an inorganic photoconductor such as ZnO, CdS, etc., dispersed in a binder. It is also possible to use a laminate of a charge generating layer and a charge transporting layer.

The protective layer may be comprised of a layer of an organic polymer having added thereto a proper organic compound or an inorganic compound. Excellent results are obtained when an electroconductive material composed of an organic polymer containing an electron donor and/or an electron acceptor are used. Similar results are obtained using an electroconductive material composed of an organic polymer having dispersed therein an electroconductive metal or metal oxide having an average particle size below 0.3 μm, more preferably below 0.15 μm. If the particle sizes are larger than 0.3 μm, the layer becomes opaque, while if the particle sizes are less than 0.3 μm, the layer becomes substantially transparent and hence the transmission of light is not prevented.

Examples of organic polymers which can be used as the binder for the protective layer include polystyrene, acryl resins, polyamides, polyesters, polyurethanes, polycarbonates, polyvinyl formal, polyvinyl acetal, polyvinyl butyral, ethyl cellulose, nitrocellulose, cellulose acetate and the like. Practical examples of materials added for such a protective layer includes metallocene and a compound having at least one metallocene skeletone in the molecular structure; tetrazole and a compound having at least one tetrazole skeletone in the molecular structure; the powder of a metal such as gold, silver, aluminum, iron, copper, nickel, etc., having a mean particle size of less than 0.3μ; the powder of a metal oxide such as zinc oxide, titanium oxide, tin oxide, bismuth oxide, indium oxide, antimony oxide, etc., having a mean particle size below 0.3μ; a powder containing tin oxide and antimony oxide in a single particle.

The elwectrophotographic photosensitive materials of this invention are explained below by referring to the following examples and comparative examples.

COMPARATIVE EXAMPLE 1

In dichloromethane were dissolved 80 parts by weight of polycarbonate and 20 parts by weight of dimethylferrocene. The solution was coated on the vapor-deposited layer (55μ thick) of $As_2Se_3$ formed on an aluminum base plate and dried to provide a photosensitive material having a protective layer 10μ thick.

The vapor-deposited layer of $As_2Se_3$ of the photosensitive material (without having the protective layer) was positively charged and exposed to light having a wave length of 460 nm at an initial potential of 800 volts. This operation was repeatedly applied to the layer at a speed of 40 times per minute. The residual potential was stable at 0 volt. On the other hand, when the vapor-deposited layer of $As_2Se_3$ of the photosensitive material having the protective layer was subjected to charging and light-exposure under the same condition as above, the initial potential was 200 volts and the residual potential was stable at 100 volts.

Therefore, the $As_2Se_3$ type photosensitive material having the protective layer had a substantially lower electrostatic contrast as compared with the photosensitive material having no such protective layer.

EXAMPLE 1

A vapor-deposited layer of $As_2Se_3$ was formed on an aluminum base plate as in Comparative Example 1. The layer was further coated with a solution composed of 1 part by weight of ethylacetoacetate aluminum diisopropylate (ALCH, trade name, made by Kawaken Fine Chemical Co., Ltd.) and 10 parts by weight of isopropyl alcohol by dip coating and drying for 2 hours at 50° C. to form an interlayer 0.5μ thick. Then, a protective layer 10μ in thickness, having the same composition as in the Comparative Example 1 was further formed on the layer. When the photosensitive material was repeatedly charged and light-exposed in the same manner as in Comparative Example 1, the initial potential was 910 volts and the residual potential was stable at 105 volts. Therefore, the electrostatic contrast was 805 volts and the property was very superior to that of the photosensitive material having only the protective layer and same as that of the photosensitive material having no protective layer.

EXAMPLE 2

A vapor-deposited layer of $As_2Se_3$ was formed on an aluminum base plate in the same manner as in Comparative Example 1. The layer was coated with a solution composed of 2 parts by weight of zinc bis(acetylacetonate), 1 part by weight of silane coupling agent (KBM 503, trade name, made by Shinetsu Chemical Co., Ltd.), and 20 parts by weight of n-butyl alcohol. The coating was formed by spray coating and drying for 30 minutes at 100° C. to form an interlayer 0.5μ thick. Then, a 10μ thick protective layer having the same composition as Comparative Example 1 was formed on the layer. When the photosensitive material was repeatedly charged and light-exposed in the same manner as Comparative Example 1, the initial potential was 900 volts and the residual potential was 105 volts. Therefore, the electrostatic contrast of the photosensitive material was 795 volts, which was same as that of the photosensitive material having no protective layer.

EXAMPLE 3

A vapor-deposited layer of $As_2Se_3$ was formed on an aluminum base plate in the same manner as in Comparative Example 1.

Then, the layer was coated with a solution composed of 1 part by weight of cobalt(II) acetylacetonate and 10 parts by weight of n-butyl alcohol. The coated layer was dried for 2 hours at 50° C. to form an interlayer 0.3μ thick. A protective layer 10μ thick having the same composition as Comparative Example 1 was formed on the layer.

When the photosensitive layer was repeatedly charged and light-exposed in the same manner as in Comparative Example 1, the initial potential was 910 volts and the residual potential was 100 volts. Therefore, the electrostatic contrast of the photosensitive material was 810 volts, which was further superior to the electrostatic contrast of the photosensitive material having no protective layer.

COMPARATIVE EXAMPLE 2

In dichloromethane were dissolved 80 parts by weight of a polyacrylate resin (U-Polymer, trade name, made by UNITIKA Ltd.) and 20 parts by weight of ferrocene. The solution was coated on a double layer type photoconductor comprising a Se vapor-deposited layer (50μ thick) and a Se-Te alloy vapor-deposited layer (1μ thick) formed on an aluminum drum of 300 mm length and dried to provide a photosensitive material having a protective layer 15μ thick.

When the photosensitive material was repeatedly charged and light-exposed in the same manner as in Comparative Example 1, the initial potential was 400 volts and the residual potential was stable at 90 volts.

On the other hand, when the photosensitive material having the above described Se/Se-Te vapor-deposited double layers but having no protective layer was repeatedly charged and light-exposed under the same conditions as above, the initial potential was 900 volts and the residual potential was 10 volts. Therefore, the Se/Se-Te double layer type photosensitive material having the protective layer had a very low electrostatic contrast as compared with the photosensitive material having no protective layer.

EXAMPLE 4

In the same manner as in Comparative Example 2, a photosensitive layer composed of Se/Se-Te alloy vapor-coated double layers was formed on an aluminum drum. Then, a solution composed of 1 part by weight of zinc bis(acetylacetonate) and 10 parts by weight of n-butanol was coated on the layer by spray coating. The coating was dried for 3 hours at 40° C. to form an interlayer 0.3μ thick. Then, a protective layer 15μ thick was formed having the same composition as in Comparative Example 2. When the photosensitive material was repeatedly charged and light-exposed in the same manner as in Comparative Example 2, the initial potential was 990 volts and the residual potential was 100 volts. Therefore, the electrostatic contrast of the photosensitive material was 890 volts, which was same as that of the photosensitive material having no protective layer.

When a copy test was performed by a magnetic brush development process using the photosensitive material, very sharp images the same as the exposure pattern were obtained.

COMPARATIVE EXAMPLE 3

The photosensitive material having the Se/Se-Te vapor-deposited double layers as in Comparative Example 2 was coated with a resin dispersion prepared by dispersing 30 parts by weight of tin oxide having particle sizes below 0.1 μm in 70 parts by weight (as the solid content) of polyurethane resin (Rethan 4000, made by Kansai Paint Co., Ltd.). The coating was dried to form a protective layer 10μ thick. When the photosensitive material was repeatedly charged and light-exposed in the same manner as in Comparative Example 1, the initial potential was 150 volts and the residual potential was 85 volts, the electrostatic contrast being very low.

EXAMPLE 5

A photosensitive layer composed of Se/Se-Te double layers as in Comparative Example 2 was coated with solution composed of 1 part by weight of ethyl acetoacetate aluminum isopropylate (ALCH, trade name, made by Kawaken Fine Chemical Co., Ltd.) and 10 parts by weight of n-butanol by dip coating. The coating was dried to form an interlayer 0.5μ thick. Then, a protective layer 10μ thick having the same composition as in Comparative Example 3 was formed.

When the photosensitive material was repeatedly charged and light-exposed in the same manner as in Comparative Example 1, the initial potential was 990 volts and the residual potential was stable at 100 volts. Therefore, the electrostatic contrast was 890 volts, which was same as that of the photosensitive material having no protective layer.

When a copy test was performed by a magnetic brush development process using the photosensitive material, very sharp images the same as the exposure pattern were obtained.

EXAMPLE 6

An $As_2Se_3$ vapor-deposited layer was formed on an Al base plate in the same manner as in Comparative Example 1. Then, on the layer was dip-coated a solution composed of 1 part by weight of tetra-n-butyl orthotitanate (Orgatics TA 25, trade name, made by Matsumoto Kosho K.K.) and 10 parts by weight of isopropyl alcohol followed by drying for 2 hours at 100° C. to provide an interlayer 0.5μ thick. Then, on the layer was formed a protective layer 10μ thick having the same composition as that in Comparative Example 1. When the charging and exposing operation was repeatedly applied to the photosensitive material by the same manner as in Comparative Example 1, the initial potential was 900 volts and the residual potential was 105 volts. Thus, the electrostatic contrast was 795 volts and hence the characteristics were greatly improved as compared with the photosensitive material having the protective layer only. The characteristics were the same as those of the photosensitive material having no such protective layer.

EXAMPLE 7

An $As_2Se_3$ vapor-deposited layer was formed on an Al base plate by the same manner as in Comparative Example 1. Then, on the layer was spray-coated a solution composed of 1 part by weight of tetra-n-butyl orthotitanate, 1 part by weight of methyl(trimethoxy)silane, 30 parts by weight of isopropyl alcohol, and 5 parts by weight of n-butyl alcohol. The coated layer was then subjected to hydrolysis at 50° C. and a high humidity condition of 80% RH. The coating was then dried for 2 hours at 100° C. to form an interlayer 0.3μ thick. Then, on the layer was formed a protective layer 15μ thick having the same composition as that in Comparative Example 1. The charging and exposing operation was then applied to the light-sensitive material in the same manner as in Comparative Example 1. The initial potential was 935 volts and the residual potential was 140 volts. Thus, the electrostatic contrast was 795 volts, which is same as that of the photosensitive material having no such protective layer.

EXAMPLE 8

An $As_2Se_3$ vapor-deposited layer was formed on an Al base plate by the same manner as in Comparative Example 1. Then, on the layer was spray-coated a solution composed of 2 parts by weight of diisopropoxy titanium bis(acetylacetonate), 1 part by weight of γ-acryloxypropyltrimethoxysilane (KBM 503, trade name, made by Shinetsu Chemical Co., Ltd.) and 20 parts by weight of n-butanol, followed by drying for 2 hours at 100° C. to form an interlayer 0.6μ thick. Then, on the layer was formed a protective layer 10μ thick having the same composition as that in Comparative Example 1.

When the charging and exposing operation was repeatedly applied to the photosensitive material in the same manner as in Comparative Example 1, the initial potential was 920 volts and the residual potential was 120 volts. Thus, the electrostatic contrast of the photosensitive material was 800 volts, which is same as the electrostatic contrast of the photosensitive material having no such protective layer.

EXAMPLE 9

On a Se/Se-Te double layer-type photosensitive layer as in Comparative Example 3 was spray-coated a solution composed of 2 parts by weight of diisopropoxy titanium bis(acetylacetonate), 1 part by weight of a silicone epoxy resin (SR 2115, trade name, made by Toray Silicone Co., Ltd.), and 20 parts by weight of butyl acetate, followed by drying for 3 hours at 40° C. to form an interlayer of 0.5μ thick.

Then, on the layer was formed an protective layer 20μ. thick having the same composition as that in Comparative Example 3. When the charging and exposing operation was repeatedly applied to the photosensitive material by the same manner as in Comparative Example 3, the initial potential was 1000 volts and the residual potential was 200 volts. Thus, the electrostatic contrast was 800 volts which is same as that of the photosensitive material having no such protective layer. When a copy test by a magnetic brush development was performed using the photosensitive material, a very clear image of the exposure pattern was obtained.

EXAMPLE 10

An $As_2Se_3$ vapor-deposited layer was formed on an Al base plate in the same manner as in Comparative Example 1. A solution composed of 1 part by weight of zirconium tetra-n-butyrate and 10 parts by weight of isopropyl alcohol was coated on the layer by dip coating and was dried for 2 hours at 40° C. to form an interlayer 0.5μ thick. A protective layer 10μ thick having the same composition as in Comparative Example 1 was then formed on the layer. When the charging and exposing operation was repeatedly applied to the photosensitive material in the same manner as in Comparative Example 1, the initial potantial was 900 volts and the residual potential was 103 volts.

Therefore, the electrostatic contrast was 797 volts and the characteristics were greatly improved as compared to those of the photosensitive material having only the protective layer. The characteristics were the same as those of the photosensitive material having no protective layer.

EXAMPLE 11

An $As_2Se_3$ vapor-deposited layer was formed on an Al base plate in the same manner as in Comparative Example 1. Then, on the layer was spray-coated a solution composed of 1 part by weight of zirconium tetrakis(acetylacetonate), 1 part by weight of methyl(trimethoxy)silane, 30 parts by weight of isopropyl alcohol, and 5 parts by weight of n-butyl alcohol. The coating was dried for 2 hours at 40° C. to form an interlayer 0.3μ thick.

Then, on the interlayer was formed a protective layer 15μ thick as in Comparative Example 1. When the charging and exposing operation as in Comparative Example 1 was repeatedly applied to the photosensitive material, the initial potential was 935 volts and the residual potential was 145 volts. Therefore, the electrostatic contrast of the photosensitive material was 790 volts which is same as that of the photosensitive material having no such protective layer.

EXAMPLE 12

An $As_2Se_3$ vapor-deposited layer was formed on an Al base plate by the same manner as in Comparative Example 1. Then, a solution composed of 2 parts by weight of zirconium tetrakis(acetylacetonate), 1 part by weight of γ-acryloxypropyltrimethoxysilane (KBM 503, trade name, made by Sinetsu Chemical Co., Ltd.), and 20 parts by weight of n-butanol was spray-coated on the layer. The coating was dried for 2 hours at 100° C. to form an interlayer 0.6μ thick. Then, on the layer was formed a protective layer 10μ thick having the same composition as in Comparative Example 1.

When the charging and exposing operation was repeatedly applied to the photosensitive material by the same manner as in Comparative Example 1, the initial potential was 915 volts and the residual potential was 115 volts. Therefore, the electrostatic contrast of the photosensitive material was 800 volts which was same as the electrostatic contrast of the photosensitive material having no protective layer.

EXAMPLE 13

On a Se/Se-Te double layer-type photosensitive layer as in Comparative Example 3 was spray-coated a solution composed of 2 parts by weight of zirconium tetra-n-butyrate, 1 part by weight of dimethyl(dimethoxy)silane, and 20 parts by weight of isopropyl alcohol. The coating was dried for 3 hours at 40° C. to form an interlayer 0.5μ thick.

Then, on the interlayer was formed a protective layer 20μ thick having the same composition as that in Comparative Example 3. When the charging and exposing operation was repeated applied to the photosensitive material in the same manner as in Comparative Example 3, the initial potential was 995 volts and the residual potential was 195 volts. Therefore, the electrostatic contrast was 800 volts which was same as that of the photosensitive material having no such protective layer. When a copy test by a magnetic brush developing method was performed using the photosensitive material, a very clear image of the exposure pattern was obtained.

The electrophotographic photosensitive materials having the interlayer of this invention has advantages over conventional electrophotographic photosensitive materials having a low-resistant protective layer formed on the surface of the photoconductive layer in that:

(i) the initial potential and electrostatic contrast increases;

(ii) the residual potential becomes stable;

(iii) changes in the initial potential and residual potential are minimized even in repeated operations for copying;

(iv) it can prevent the protective layer from being separated from the photoconductive layer; and (v) since the interlayer can be formed at normal temperature, the photoconductive layer is free from deteriorations (crystallization, changes in sensitivity, etc.) due to heat during the formation of interlayer.

While the invention has been described in detail and with reference to specific embodiment thereof, it will be apparent to one skilled in the art that various changes and modifications can be made therein without departing from the spirit and scope thereof.

What is claimed is:

1. An electrophotographic photosensitive material, comprising:

a conductive support having a surface;

a photoconductive layer formed on the surface;

an interlayer formed on the photoconductive layer by curing a coating solution of an organic metal compound as its main component; and a low-resistance protective layer positioned over the interlayer.

2. An electrophotographic photosensitive material as claimed in claim 1, wherein the organic metal compound is selected from the group consisting of aluminum tris(acetylacetonate), iron tris(acetylacetonate), cobalt bis(acetylacetonate), copper bis(acetylacetonate), magnesium bis(acetylacetonate), manganese(II) bis(acetylacetonate), nickel(II) bis(acetylacetonate), vanadium tris(acetylacetonate), zinc bis(acetylacetonate), tin bis(acetylacetonate), aluminum isopropylate, mono-sec-butoxy aluminum diisopropylate, aluminum sec-butyrate, ethylacetoacetate aluminum diisopropylate, vanadium ethylate, vanadium n-propylate, vanadium isobutyrate, aluminum di-n-butoxide mono-ethylacetoacetate, aluminum oxide octate, aluminum oxide stearate and aluminum oxide acrylate.

3. An electrophotographic photosensitive material as claimed in claim 2, wherein the organic metal compound is aluminum tri(acetylacetonate), cobalt bis(acetylacetonate) or zinc bis(acetylacetonate).

4. An electrophotographic photosensitive material as claimed in claim 1, wherein the organic metal compound is an organotitanium compound.

5. An electrophotographic photosensitive material as claimed in claim 4, wherein the organotitanium compound is selected from the groups consisting of titanium orthoesters, polyorthotitanic acid esters, and titanium chelates.

6. An electrophotographic photosensitive material as claimed in claim 5, wherein the organotitanium compounds is selected from the group consisting of tetramethyl orthotitanate, tetraethyl orthotitanate, tetra-n-propyl orthotitanate, tetraisopropyl orthotitanate, tetrabutyl orthotitanate, tetraisobutyl orthotitanate, tetracresyl titanate, tetrabutyl polytitanate and diisopropoxy titane bis(acetylacetonate).

7. An electrophotographic photosensitive material as claimed in claim 1, wherein the organic metal compound is an organozirconium compound.

8. An electrophotographic photosensitive material as claimed in claim 7, wherein the organozirconium compound is selected from the groups consisting of zirconium complexes and zirconium esters.

9. An electrophotographic photosensitive material as claimed in claim 8, wherein the organozirconium compound is selected from the group consisting of zirconium tetrakis(acetylacetonate), zirconium dibutoxy bis(acetylacetonate), zirconium tributoxy acetylacetonate and zirconium n-butyrate.

10. An electrophotographic photosensitive material as claimed in claim 1, wherein the interlayer is 10 $\mu$m thick or less.

11. An electrophotographic photosensitive material as claimed in claim 10, wherein the interlayer is 1 $\mu$m thick or less.

12. An electrophotographic photosensitive material as claimed in claim 1, wherein the interlayer has an electric resistance of from $10^8$ to $10^{14}$ $\Omega$cm.

13. An electrophotographic photosensitive material as claimed in claim 12, wherein the interlayer has an electric resistance of from $10^{10}$ to $10^{13}$ $\Omega$cm.

14. An electrophotographic photosensitive material as claimed in any of claims 1, 12 or 13, wherein the coating solution further contains a resistance-controlling agent.

15. An electrophotographic photosensitive material as claimed in claim 14, wherein the resistance-controlling agent is selected from the group consisting of silicate compounds and silane coupling agents.

16. An electrophotographic photosensitive material as claimed in claim 1, wherein the coating solution further contains a catalyst for accelerating the curing reaction of the interlayer.

17. An electrophotographic photosensitive material as claimed in claim 1, wherein the protective layer is composed of an organic polymer containing an electron donor and/or an electron acceptor.

18. An electrophotographic photosensitive material as claimed in claim 1, wherein the protective layer is composed of an organic polymer having dispersed therein an metal or metal oxide having an average particle size below 0.3 $\mu$m.

19. An electrophotographic photosensitive material as claimed in claim 1, wherein the photoconductive layer is a vacuum deposited layer of Se, Se-Te alloy, or Se-As alloy.

20. An electrophotographic photosensitive material as claimed in claim 1, wherein the photoconductive layer is a layer of an organic photoconductor.

21. An electrophotographic photosensitive material as claimed in claim 1, wherein the photoconductive layer is a layer of ZnO dispersed in a binder.

22. An electrophotographic photosensitive material as claimed in claim 1, wherein the photoconductive layer is a layer of CdS dispersed in a binder.

23. An electrophotographic photosensitive material as claimed in claim 1, wherein the protective layer is adjacent to the interlayer.

24. An electrophotographic photosensitive material as claimed in claim 1, wherein the coating solution consists essentially of an organic metal compound and a solvent.

25. An electrophotographic photosensitive material as claimed in claim 16, wherein the catalyst is added in an amount of 1 to 10% by weight based on the weight of the solid component in the coating solution.

26. An electrophotographic photosensitive material as claimed in claim 17, wherein the organic polymer is selected from the group consisting of polystyrene, acryl resins, polyamides, polyesters, polyurethanes, polycarbonates, polyvinyl formal, polyvinyl acetal, polyvinyl butyral, ethyl cellulose, nitrocellulose and cellulose acetate.

27. An electrophotographic photosensitive material as claimed in claim 1, wherein the protective layer contains a material selected from the group consisting of metallocene and a compound having at least one metallocene skeleton in its molecular structure; tetrazole and a compound having at least one tetrazole skeleton in its molecular structure; a powder of a metal selected from the group consisting of gold, silver, aluminum, iron, copper and nickel having a mean particle size of less than 0.3$\mu$; a powder of a metal oxide selected from the group consisting of zinc oxide, titanium oxide, tin oxide, bismuth oxide, indium oxide and antimony oxide having a mean particle size below 0.3$\mu$; and a powder comprising tin oxide and antimony oxide in a single particle.

* * * * *